US009091129B2

(12) United States Patent
Lancaster

(10) Patent No.: US 9,091,129 B2
(45) Date of Patent: Jul. 28, 2015

(54) INJECTOR HEAD FOR COILED TUBING SYSTEMS

(75) Inventor: Rodney Earl Lancaster, Houston, TX (US)

(73) Assignee: Stewart & Stevenson, LLC, Houston, TX (US)

( * ) Notice: Subject to any disclaimer, the term of this patent is extended or adjusted under 35 U.S.C. 154(b) by 698 days.

(21) Appl. No.: 13/439,320

(22) Filed: Apr. 4, 2012

(65) Prior Publication Data

US 2012/0247787 A1 Oct. 4, 2012

Related U.S. Application Data

(60) Provisional application No. 61/471,391, filed on Apr. 4, 2011.

(51) Int. Cl.
*E21B 19/22* (2006.01)

(52) U.S. Cl.
CPC ..... *E21B 19/22* (2013.01)

(58) Field of Classification Search
CPC ..... E21B 19/08; E21B 19/00; E21B 19/22; B66D 3/003
USPC ..... 166/77.3
See application file for complete search history.

(56) References Cited

U.S. PATENT DOCUMENTS

| | | | |
|---|---|---|---|
| 3,692,368 | A | 9/1972 | Alexander |
| 4,323,283 | A | 4/1982 | Muramoto et al. |
| 4,457,564 | A | 7/1984 | Ruge et al. |
| 5,188,174 | A | 2/1993 | Anderson, Jr. et al. |
| 5,850,874 | A | 12/1998 | Burge et al. |
| 5,890,534 | A | 4/1999 | Burge et al. |
| 5,918,671 | A | 7/1999 | Bridges et al. |
| 6,027,185 | A | 2/2000 | Crabb |
| 6,216,780 | B1 | 4/2001 | Goode et al. |
| 6,276,454 | B1 | 8/2001 | Fontana et al. |
| 6,276,768 | B1 | 8/2001 | Miller |
| 6,398,682 | B1 | 6/2002 | Suzuki et al. |
| 6,530,432 | B2 | 3/2003 | Gipson |
| 6,609,566 | B2 | 8/2003 | Perio, Jr. |
| 6,719,043 | B2 | 4/2004 | Austbo et al. |
| 6,899,650 | B2 | 5/2005 | Okuda et al. |
| 6,968,894 | B2 | 11/2005 | Austbo et al. |
| 7,051,814 | B2 | 5/2006 | Goode et al. |
| 7,467,659 | B2 | 12/2008 | Nielsen et al. |
| 2002/0046833 | A1 | 4/2002 | Perio, Jr. |
| 2004/0094306 | A1 | 5/2004 | Goode et al. |
| 2007/0137855 | A1 | 6/2007 | Nielsen et al. |

OTHER PUBLICATIONS

The International Search Report and the Written Opinion of the International Searching Authority for International Application No. PCT/US2012/031983, mailed Oct. 25, 2012.
Extended European Search Report for EP 12767602; Mar. 16, 2015.

*Primary Examiner* — Giovanna C Wright
*Assistant Examiner* — Kristyn Hall
(74) *Attorney, Agent, or Firm* — Jones Day

(57) ABSTRACT

An injector head used in coiled tubing systems including at least two opposed counter-rotating chain loops having a first end and a second end, the chain loops having a chain. The injector head further includes a fixed drive sprocket disposed at the first end of a chain loop and a floating sprocket disposed at the second end of the chain loop. In the injector head, there is a force applied to the floating bottom sprocket to maintain the chain loop at a desired chain tension. Additionally, the injector head includes a tension cylinder that automatically maintains the chain loop at the desired chain tension.

19 Claims, 16 Drawing Sheets

INJECTOR HEAD FOR COILED TUBING SYSTEMS

CROSS-REFERENCE TO RELATED APPLICATIONS

This application claims priority to U.S. Provisional Patent Application No. 61/471,391, which was filed in the U.S. Patent and Trademark Office on Apr. 4, 2011.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There has been no joint research agreements entered into with any third parties.

BACKGROUND OF THE INVENTION

1. Field of the Invention

The embodiments of the present invention relate generally to a coiled tubing injector head utilizing a tension cylinder that automatically adjusts a tension of the chain or conveyor member.

2. Description of the Related Art

In the development and production of an oil or gas well, elongated tubing may be inserted into the well from the surface for such purposes as the injection of certain types of fluids for stimulation of the production, displacing fluids in the well, for performing cleaning operations on the production tubing, as well as various other purposes. A continuous length of tubing is inserted into the well from a large reel at the surface. In the oil and gas industries, this process is known as coiled tubing. An example of an apparatus for inserting and withdrawing coiled tubing into a well can be found in U.S. Pat. No. 5,188,174 to Anderson, Jr. et al., which is hereby incorporated by reference in its entirety.

Coiled tubing units are used for interventions in oil and gas wells, and sometimes the tubing, which comes spooled on a large reel, is used as production tubing in depleted gas wells. The injector head is the heart of a coiled tubing system. Coiled tubing injector heads inject coiled tubing into an oil or gas well to facilitate the servicing of the well.

Coiled tubing injector heads are well known in the art. Coiled tubing injector heads typically have two opposed counter-rotating vertical chains loops with a fixed drive sprocket at the top and a floating sprocket at the bottom. The two opposed counter-rotating chains provide the injector head with the capability to snub coil tubing into a well with pressure. To snub the coiled tubing into a high-pressure well, the injector head must exert a significant amount of compression to overcome the resistance from the wellhead pressure. In other words, the well pressure exerts a force to eject the coil tubing from the well which must be opposed by a force applied to the bottom sprockets to keep the chain loops tight. This is known by a person skilled in the art as chain tension.

The majority of injector head chain and skate bearing failures are caused by applying an improper chain tension when operating the injector head. In the prior art, chain tension is controlled by an operator adjusting hydraulic pressure at a control panel in tension cylinders attached to lower sprocket shafts. The operator must determine the proper chain tension pressure based on the coil tubing's outside diameter and the well pressure (and in horizontal wells, the friction force acting on the coil tubing). These factors can change during the course of a drilling project, requiring the operator to monitor the snub load and chain tension pressure. It is sometimes difficult for an operator to continuously monitor the snub load. As a result, mechanical stops were added at the lower sprocket shafts in the prior art. The mechanical stops prevent the lower sprocket from moving past a predetermined setting, and must be manually adjusted as the chain wears. The chain wear (chain length elongation) is caused by pin-bushing wear (when a chain is operating, the outer surface of the pin and inner surface of the bushing rub against one another, wearing little by little). Another consideration is the position in which the chain and the sprocket engage, which fluctuates, causing the chain to vibrate along with this fluctuation. The vibration occurs because there is a pitch length in the chains, where they can only bend at the pitch point. The height of engagement (the radius from the center of the sprocket) differs when the chain engages in a tangent position and when it engages in a chord. A chain tension pressure that will keep the chains tight against a high snub force results in load spikes from the chain chordal action. At least for the reasons provided above, there is a need for an injector head used in coiled tubing systems that automatically adjusts the tension of the chain.

SUMMARY OF THE INVENTION

For the reasons included above, it is therefore an object of embodiments of the present invention to provide an injector head that automatically adjusts the tension of the chain or conveyor member.

The embodiments of the present invention allow the operator to set a proper chain tension pressure that prolongs the useful life of the chains, and provide a mechanical stop to prevent the bottom sprockets from being pushed up from the well pressure on the coil tubing. The embodiments of the present invention automatically adjust to compensate for an increase in chain length due to wear.

The embodiments of the present invention include an injector head used in coiled tubing systems including at least two opposed counter-rotating chain loops having a first end and a second end, the chain loops having a chain. The injector head of the embodiments of the present invention further includes a fixed drive sprocket disposed at the first end of a chain loop and a floating sprocket disposed at the second end of the chain loop. In the injector head of the embodiments of the present invention, there is a force applied to the floating bottom sprocket to maintain the chain loop at a desired chain tension. Additionally, the injector head of the embodiments of the present invention includes a tension cylinder that automatically maintains the chain loop at the desired chain tension.

Yet another embodiment of the present invention is directed to a tension cylinder, where the tension cylinder includes: a cylinder head and a cylinder head seal; a rod and a rod seal; a rod wiper; a cylinder barrel; a retainer; a piston seal; and a piston and a cylinder, where the piston divides the cylinder into two chambers, a first chamber and a second chamber, and each chamber includes a piston area, where the piston area is substantially the same in the first and second chambers. The tension cylinder further includes a check valve connecting the first and second chambers, where the check valve allows fluid and pressure to pass from the first chamber to the second chamber.

The embodiments of the present invention further include a method of automatically adjusting the tension of a chain in an injector head used in coiled tubing systems including applying a force to a floating sprocket to maintain a chain loop at a desired chain tension. The injector head includes: at least two opposed counter-rotating chain loops having a first end and a second end, the chain loops having a chain; and a fixed drive sprocket disposed at the first end of the chain loop, where the floating sprocket is disposed at the second end of the chain loop. The method of automatically adjusting the tension of a chain in an injector head used in coiled tubing systems further includes: preventing the floating bottom sprocket from moving toward the first end of the chain loop using a mechanical stop; and automatically maintaining the chain loop at the desired chain tension using a tension cylinder.

Yet another embodiment of the present invention is directed to an injector head used in coiled tubing systems including: at least two opposed counter-rotating vertical chain loops having a top and a bottom, the chain loops having a chain; a fixed drive sprocket at the top of a vertical chain loop and a floating sprocket at the bottom of the vertical chain loop; a force applied to the floating bottom sprocket to keep the chain loop tight thereby creating a desired chain tension; a mechanical stop to prevent the floating bottom sprocket from moving toward the top of the vertical chain loop; and a tension cylinder that automatically maintains the chain loop at the desired chain tension. The tension cylinder includes: a cylinder barrel; a cylinder head and a cylinder head seal; a rod and a rod seal; a rod wiper; a retainer ring; and a floating piston and a cylinder, where the piston divides the cylinder into two chambers, a first chamber and a second chamber, each chamber having a piston area, and where the piston area is substantially the same in the first and second chambers. The tension cylinder further includes: a spring mounted between the piston and the rod, where the spring maintains a distance substantially equivalent to chordal movement of the chain on the sprockets; a piston seal; a check valve connecting the first and second chambers, where the check valve allows fluid and pressure to pass from the first chamber to the second chamber, but the check valve does not allow fluid and pressure to pass from the second chamber to the first chamber; and two ports, a first port and a second port, where the first port is connected to a chain tension pressure control valve, and where the first port bleeds air from the cylinder, and the second port is plugged during operation of the injector head. The injector head further includes: sprocket shafts engaged with the floating bottom sprocket, where the rod includes slots that are cut into an end of the rod, the rod is connected to the sprocket shafts, and the rod is connected to the piston with the retainer ring. Additionally, the injector head includes: rollers that are engaged with the chain and move with the chain; and floating/moving traction cylinders, where forces from the chain push the rod against the floating sprocket in the chain loop. If forces push the floating sprocket toward the top of the chain loop, the rod will travel a distance substantially equal to the distance maintained by the biasing member, and the floating sprocket is prevented from moving past a location of the piston in the cylinder.

BRIEF DESCRIPTION OF THE DRAWINGS

Preferred features of the embodiments of the present invention are disclosed in the accompanying drawings, wherein similar reference characters denote similar elements throughout the several views, and wherein.

DETAILED DESCRIPTION

Figure 1:
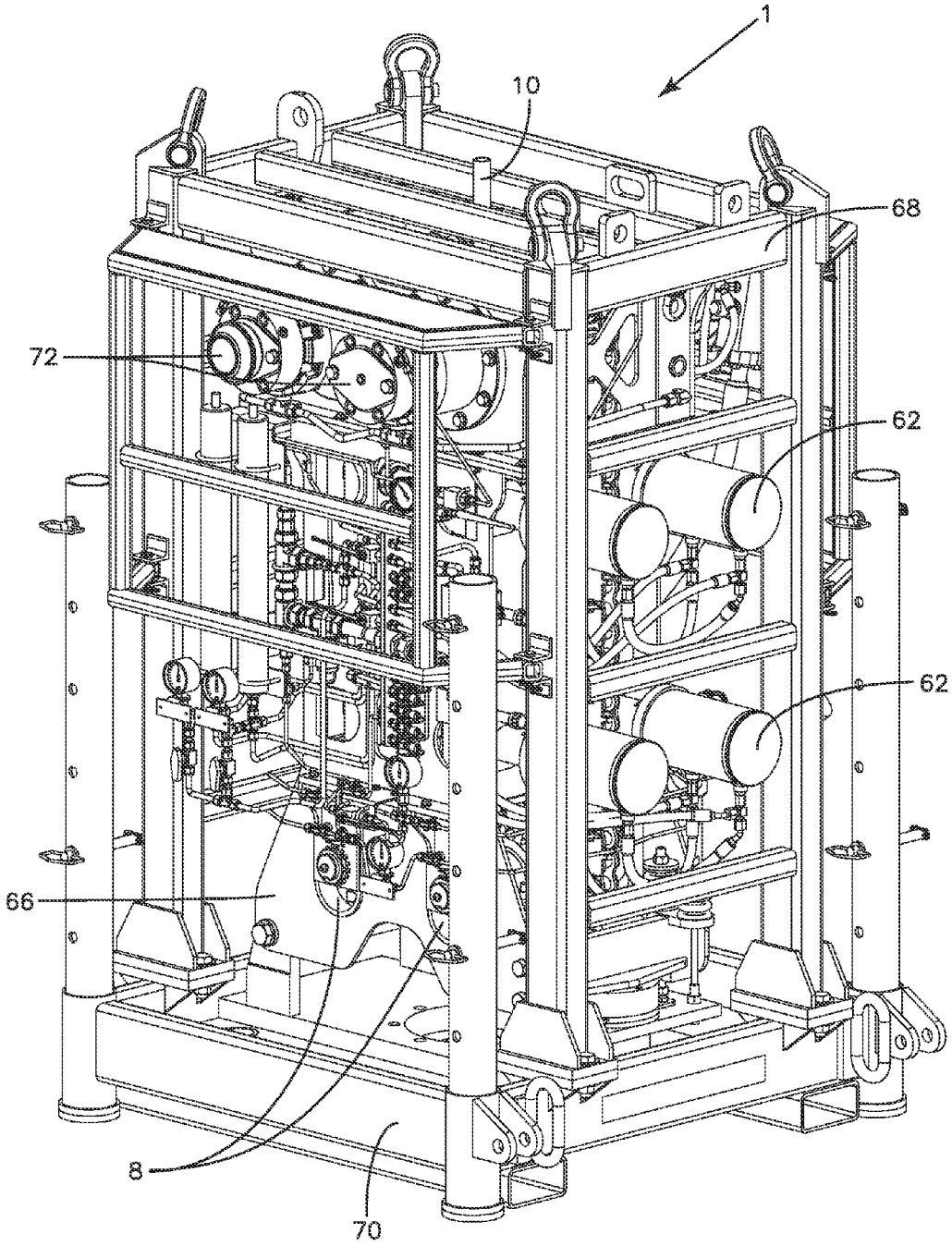
FIG. 1 is a front/side perspective view of an injector head according to an embodiment of the present invention.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "upper," "lower," "left," "right," and the like, are words of convenience and are not to be construed as limiting terms.

The embodiments of the present invention include coiled tubing injector heads 1 that have two opposed counter-rotating vertical chains loops 2 with a fixed drive sprocket 4 at the top and a floating sprocket 6 at the bottom. As understood by a person of ordinary skill in the art, a floating sprocket 6 is a sprocket that has provisions to move up or down in a slot 8 but it is not able to move sideways. The slot length is equal to the distance the floating sprocket 6 can move for an acceptable amount of chain wear. The two opposed counter-rotating chains 2 provide the injector head 1 with the capability to snub coil tubing 10 into a well with pressure. The well pressure exerts a force to eject the coil tubing 10 from the well which must be opposed by a force applied to the bottom floating sprockets 6 to keep the chain loops 2 tight (the chain tension). The tension in an embodiment of the present invention has been determined empirically. In an embodiment of the present invention, 500 psi is the minimum pressure applied to the tension cylinders 12 to provide quiet and smooth operation of the chain 2. However, in other embodiments of the present invention, the tension pressure may be different because of factors such as the tension cylinder diameter and chain pitch.

The embodiments of the present invention include a tension cylinder 12 including a cylinder barrel 14, cylinder head 16, and a rod 18. Additionally, the embodiments of the present invention include a floating piston 20, a spring 22, and a manner in which the piston 20 and rod 18 connect.

The embodiments of the present invention further include a tension cylinder 12 that allows an operator to set a proper chain tension pressure that prolongs the useful life of the chains 2 and provides a mechanical stop to prevent the bottom floating sprockets 6 from being pushed up by the well pressure on the coil tubing 10. The tension cylinder 12 included in the embodiments of the present invention automatically adjusts for an increase in chain length due to wear. The chain wear (chain length elongation) is caused by pin-bushing wear (when a chain 2 is operating, the outer surface of the pin 24 and inner surface of the bushing 26 rub against one another, wearing little by little). The chain tension pressure must therefore be consistently maintained to provide smooth and quiet operation with optimum life of the chains 2. The operator of the coil tubing unit system is not required to monitor snub loads to determine chain tension during operation and the chain 2 is not subject to high loads resulting from high chain tension pressure.

As shown in the figures submitted herewith, the tension cylinder 12 included in the embodiments of the present invention includes a piston 20 and a cylinder 14, where the piston 20 divides the cylinder 14 into two chambers—a first chamber 28 and a second chamber 30. The piston area is substantially the same in the first and second chambers 28, 30. A check valve 32 connects the first chamber 28 to the second chamber 30 allowing fluid and pressure to pass from the first chamber 28 into the second chamber 30, but not from second chamber 30 into the first chamber 28.

The tension cylinder 12 also includes a cylinder head 16, a cylinder head seal 36, a rod seal 38, a rod wiper 40, a cylinder barrel 14, a retainer 34, and a piston seal 42.

Elements of the tension cylinder 12 included in an embodiment of the present invention will now be described.

The cylinder barrel 14 is typically made of steel and is a seamless thick walled tube, with a cylinder shaped component, also typically made of steel, welded at one end where the inner diameter is machined. However, one skilled in the art will understand that the cylinder barrel, and other components of the tension cylinder 12 may be constructed of additional materials other than those described herein.

The cylinder head 16 is a cylinder shaped component, typically made of steel, that attaches to the open end of the cylinder barrel 14 and contains a cylinder head seal 36, a rod seal 38 and a rod wiper 40.

The cylinder head seal 36 is typically made of an elastomeric material and is the component that seals the clearance between the cylinder head 16 and cylinder barrel 14.

The rod seal 38 is typically made of an elastomeric material and is the component that seals the clearance between the cylinder head 16 and the cylinder rod 18.

The rod wiper 40 is typically made of a hard elastomeric material and is the component that scrapes contaminates from the exposed portion of the rod 18 before it moves through the rod seal 38.

The rod 18 is a cylinder shaped component, typically made of steel, that extends from the cylinder 14 and has one end machined to attach to the injector head lower shaft 44 and the opposite end machined to contain the biasing member 22 (typically a spring) and attach to the piston 20. The injector head lower shaft 44 may include the floating sprockets 6 in an embodiment of the present invention.

The piston 20 is a cylinder shaped component, typically made of steel, that separates the two chambers 28, 30 of the cylinder barrel 14 internally.

The piston seal 42 is typically made of an elastomeric material and is the component that seals the clearance between the piston 20 and cylinder barrel 14.

The biasing member 22 is a spring in the preferred embodiment of the present invention. The biasing member 22 is an elastic device that stores energy used to maintain a predetermined distance between the rod 18 and piston 20. One skilled in the art would readily understand that the biasing member 22 may be in the form of any elastic device that stores energy. For example, the biasing member 22 may be leaf springs, coil springs, torsion bars, or a combination of these, or the like. The biasing member 22 may also be an elastic material.

The retainer 34 is a device that attaches the rod 18 to the piston 20.

The check valve 32 is a mechanical device that allows fluid to flow through it in only one direction.

The tension cylinder 12 further includes two ports—a first port 46 and a second port 48. The first port 46 is connected to a chain tension pressure control valve 50.

A rod 18 is connected to the lower sprocket shafts 44, and the rod 18 includes slots 52 that are cut into the end 54 of rod 18. The rod 18 is connected to the piston 20 with a retainer 34. The retainer 34 may be a retainer ring as depicted in the figures. One skilled in the art would readily understand that different means may be used to connect the rod 18 and the piston 20 including, but not limited to, a clip or a pin.

Chordal movement is the difference between the pitch radius and the distance from the center of the sprocket 6 to the chord (when a chain engages a sprocket, the centers of the chain joints lie on the pitch circle of the sprocket and the center line of each link forms a chord of this circle). A spring 22 is mounted between the piston 20 and the rod 18 and the spring 22 maintains a distance equivalent to the chordal movement of the chain 2 on the sprocket 6. This distance needs to be at a minimum to restrict slack in the chain 2 at a high snub load.

In an embodiment of the present invention, the second port 48 bleeds air from the cylinder 14, and second port 48 is plugged during operation.

In the embodiments of the present invention, the chain tension pressure pushes the rod 18 against the lower floating sprocket 6 in the chain 2. The pressure is substantially equal in first and second chambers 28, 30, and because the piston area is substantially the same in both chambers, the piston 20 is not forced to move in either direction. The spring 22 between the rod 18 and the piston 20 maintains clearance for the rod 18 to move as the lower sprocket shaft 44 fluctuates from chordal action. As the chain 2 wears and increases in length, the check valve 32 in the piston 20 allows fluid to flow from the first chamber 28 into the second chamber 30 as the tension pressure extends the rod 18 moving the lower sprockets 6 down until the lower sprocket 6 is supported by the chain 2. If the snub force on the coil tubing 10 pushes the lower sprockets 6 up, the rod 18 will travel a distance equal to the clearance maintained by the spring 22 between the rod 18 and the piston 20. In the embodiments of the present invention, the hydraulic fluid is incompressible and the check valve 32 prevents the fluid from flowing from the second chamber 30 to the first chamber 28. Additionally, the lower sprockets 6 are prevented from moving past the piston location in the cylinder 14.

An embodiment of the present invention could be used in any chain drive that requires hydraulic tensioning. Another embodiment of the present invention includes a relief valve 56 installed at the second port 48 which can be used in, for example, a tension system that requires a maximum limit.

The embodiments of the present invention remove the manual maintenance of the lower sprocket stops which an operator sometimes has difficulty in maintaining. Additionally, the embodiments of the present invention provide the optimum distance in which the lower sprocket shaft 44 travels before contacting the stop.

Figure 12:
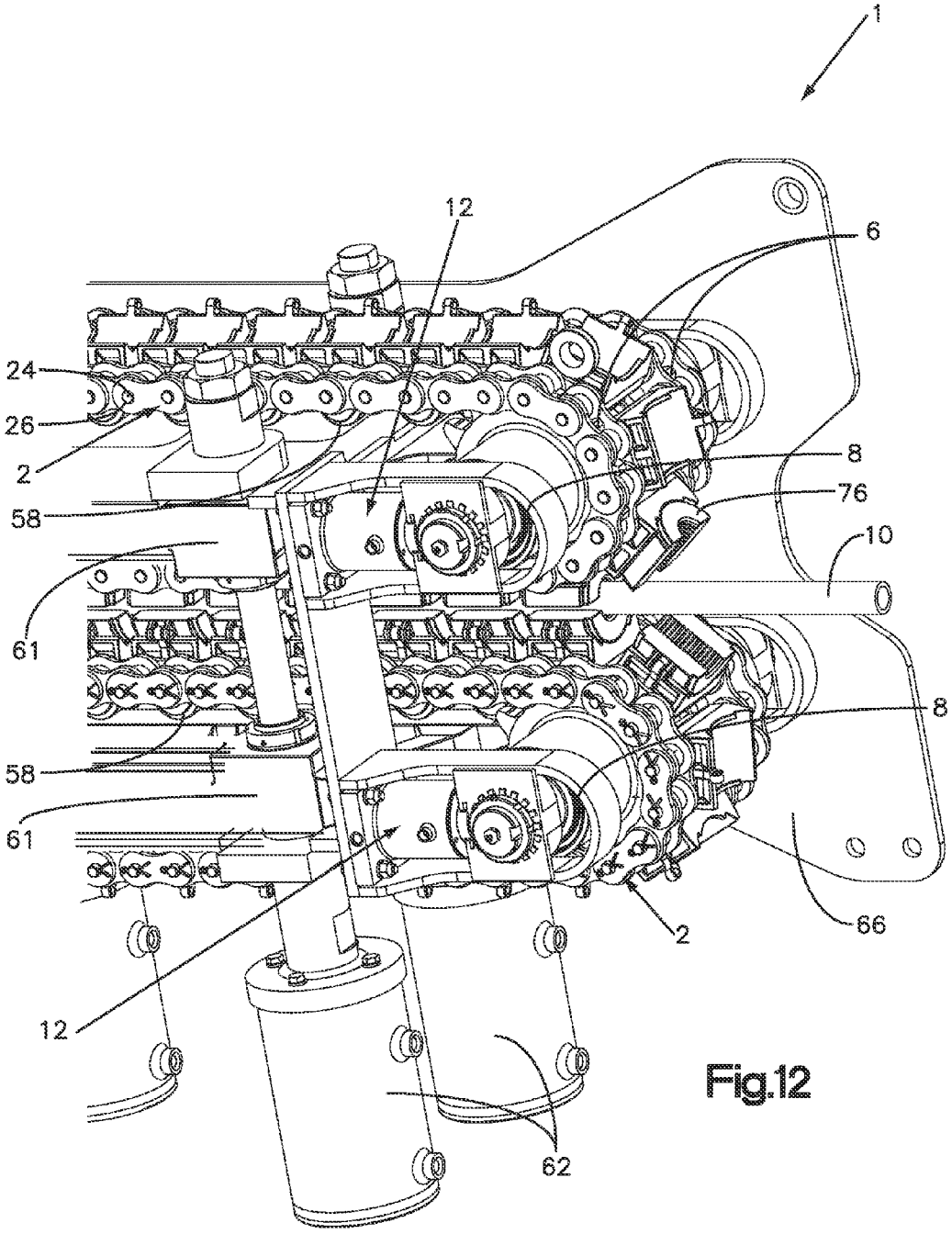
FIG. 12 is a bottom perspective view of an injector head according to an embodiment of the present invention.
Figure 13:
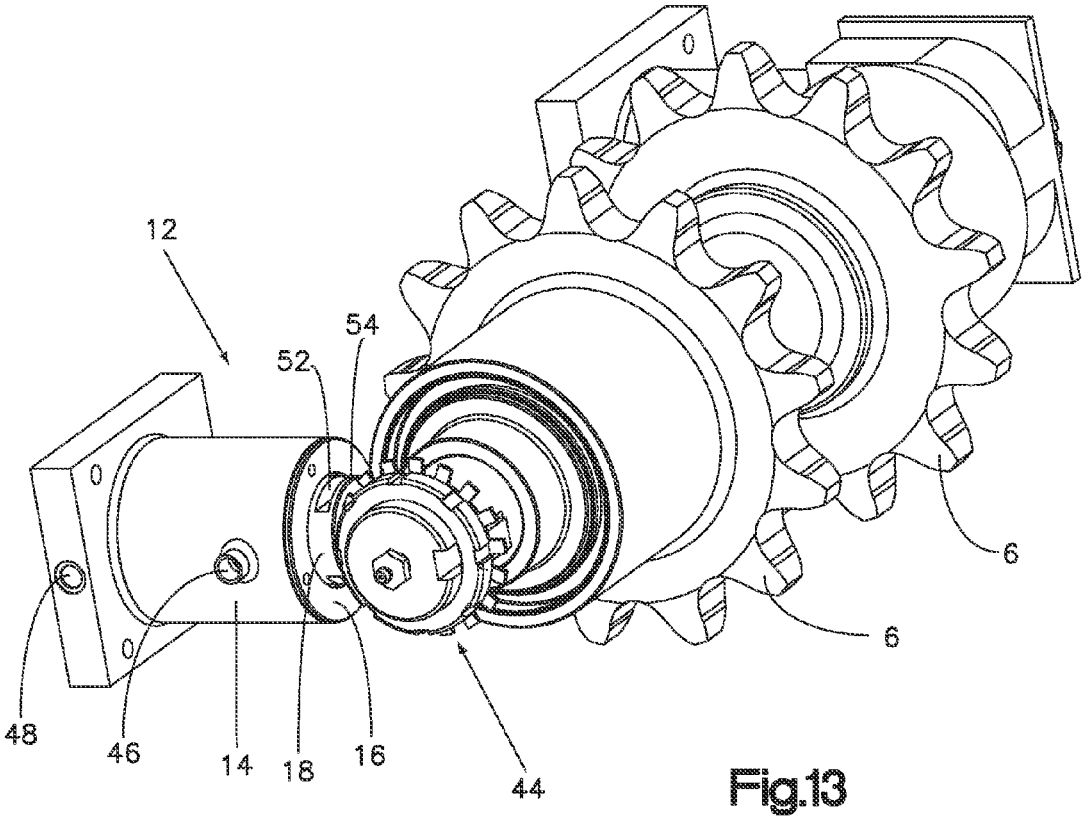
FIG. 13 is a side perspective view of an injector head lower shaft according to an embodiment of the present invention.
Figure 14:
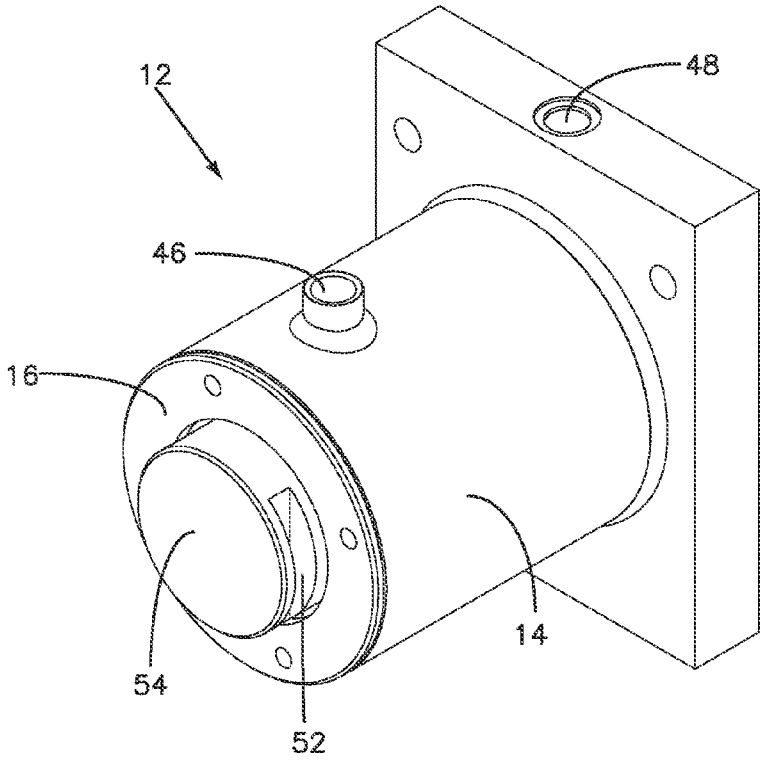
FIG. 14 is a rear-side perspective view of a tension cylinder according to an embodiment of the present invention.
Figure 15:
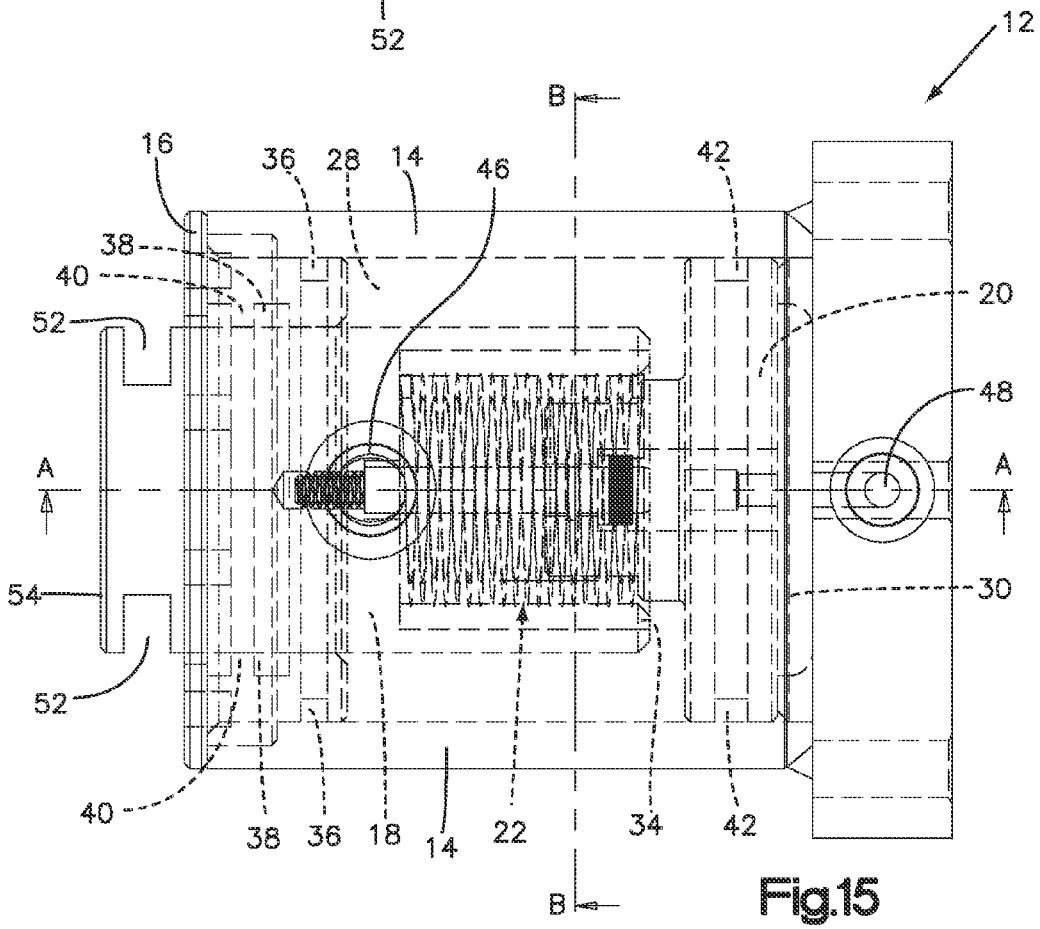
FIG. 15 is a side sectional view showing the inner workings of a tension cylinder according to an embodiment of the present invention.
Figure 16:
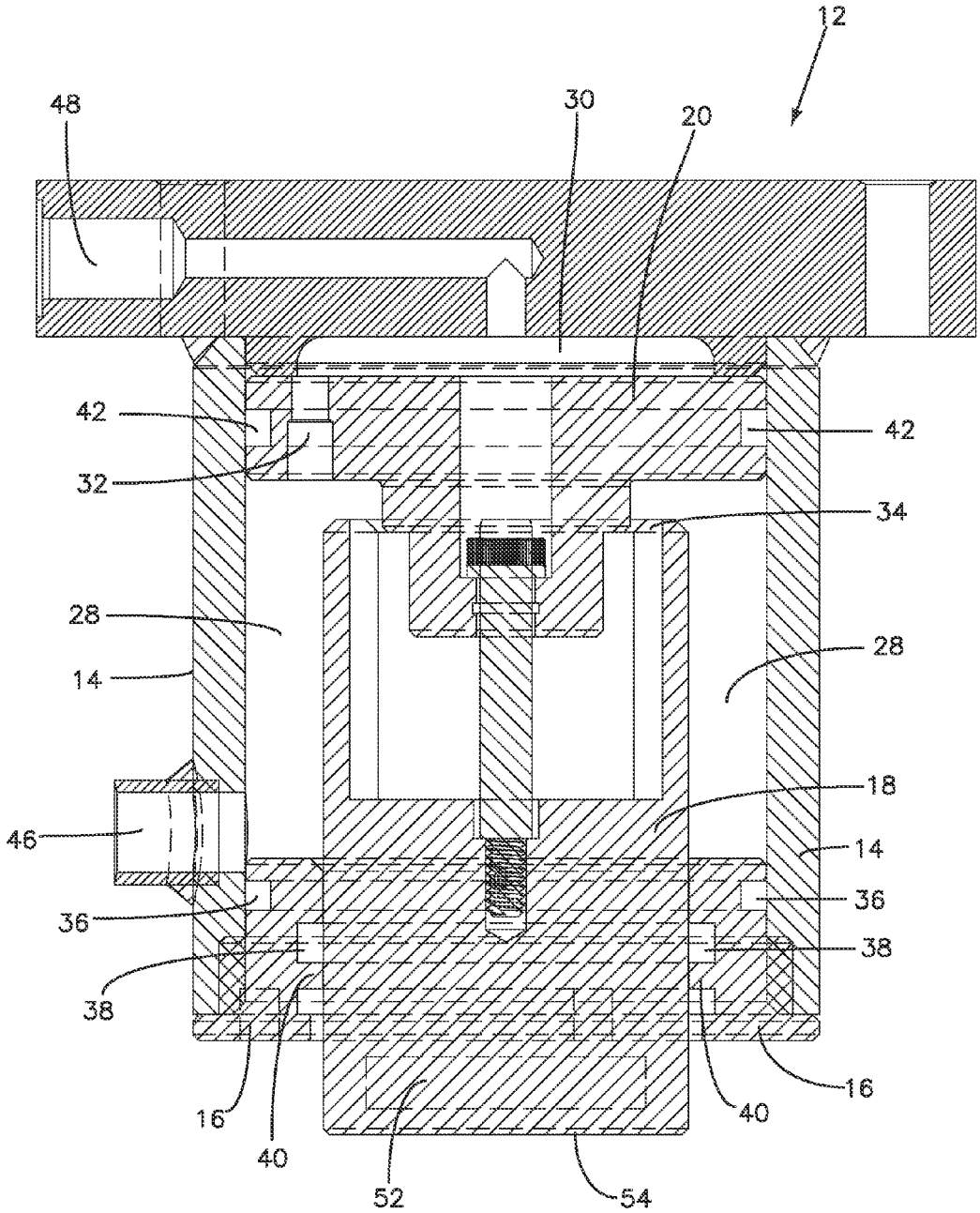
FIG. 16 is a cross-sectional side view of a tension cylinder according to an embodiment of the present invention.
Figure 17A:
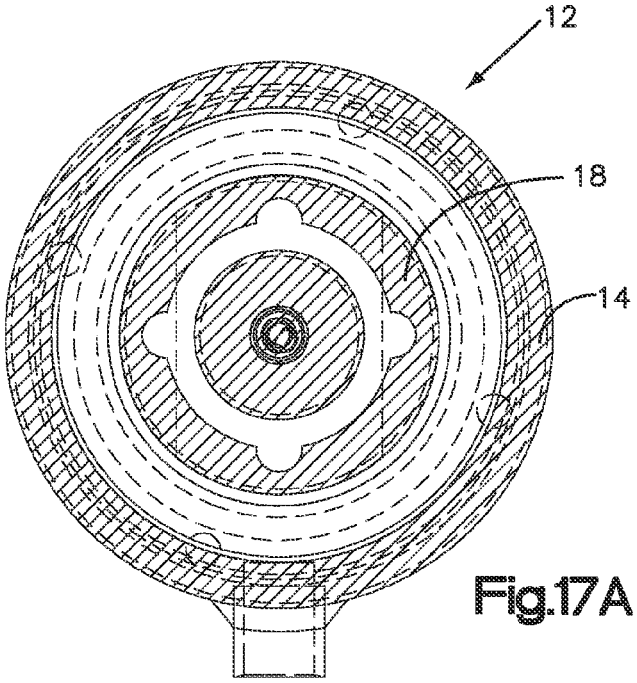
FIG. 17A is a top sectional view showing the inner workings of a tension cylinder according to an embodiment of the present invention.
Figure 17B:
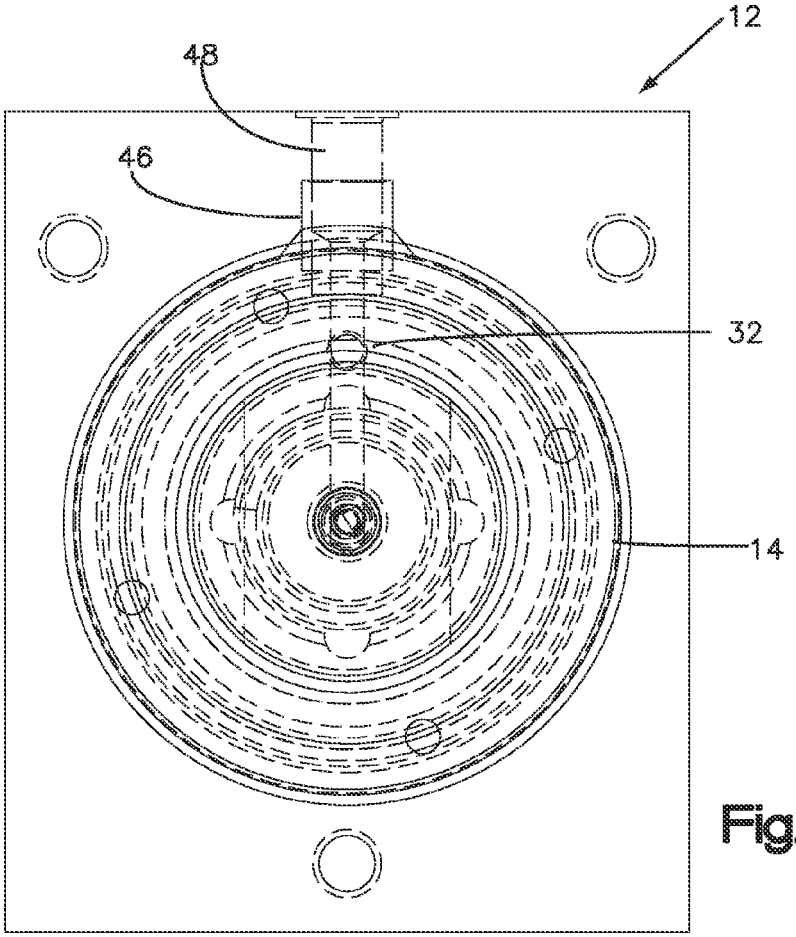
FIG. 17B is a bottom view of a tension cylinder according to an embodiment of the present invention.

As depicted in FIG. 12, in an embodiment of the present invention, the self-adjusting chain tensioning mechanism with a check valve in a cylinder as described above is used in an injector head that includes rollers 58 that are moving and installed with the chain 2. Conversely, in another embodiment of the present invention, the self-adjusting chain tensioning mechanism with a check valve in a cylinder as described above is used within an injector head that includes stationary rollers that are installed in the skates 61. The skates 61 are the elements that include the rollers in this embodiment. Additionally, the skates 61 are the members that are adapted to engage the ram 64 of the piston 60 of the traction cylinders 62 in an embodiment of the present invention. In an embodiment of the present invention, the gripping force on the coiled tubing 10 may be controlled by the amount of force applied by the traction cylinders 62.

Additionally, as depicted in the Figures, in an embodiment of the present invention, the self-adjusting chain tensioning mechanism with a check valve in a cylinder as described above is used within an injector head that includes floating/moving traction cylinders 62. Conversely, in another embodiment of the present invention, the self-adjusting chain tensioning mechanism with a check valve in a cylinder as described above is used within an injector head that includes stationary traction cylinders.

In the embodiment of the present invention shown in FIG. 1, the coiled tubing injector head 1 includes an inner frame 66, an outer frame 68, and a base frame 70. As is known to those skilled in the art, the various structural members of the frames 66, 68, 70 may include a variety of commonly used structural components, such as plates, I-beams, channel beams, structural tubing, and the like, that are sized and configured in a manner sufficient to withstand all of the forces encountered in normal coiled tubing operations. The design, selection, and sizing of these various components are matters of design choice that are well within the level of ordinary skill in the present art. The coiled tubing injector head 1 further includes drive assemblies 72 that include drive motors that are typically used in the art, for example, hydraulic motors. A person of ordinary skill will understand that various drive means may be used with the coiled tubing injector head 1 according to the embodiments of the present invention. The drive assemblies 72 are connected to drive shafts, which include the drive sprockets 4 that drive the chains 2. The coiled tubing injector head 1 depicted in FIG. 1 includes many accessories and represents a typical complete coiled tubing injector head 1 in the art with the enhanced and novel features described herein.

Figure 2:
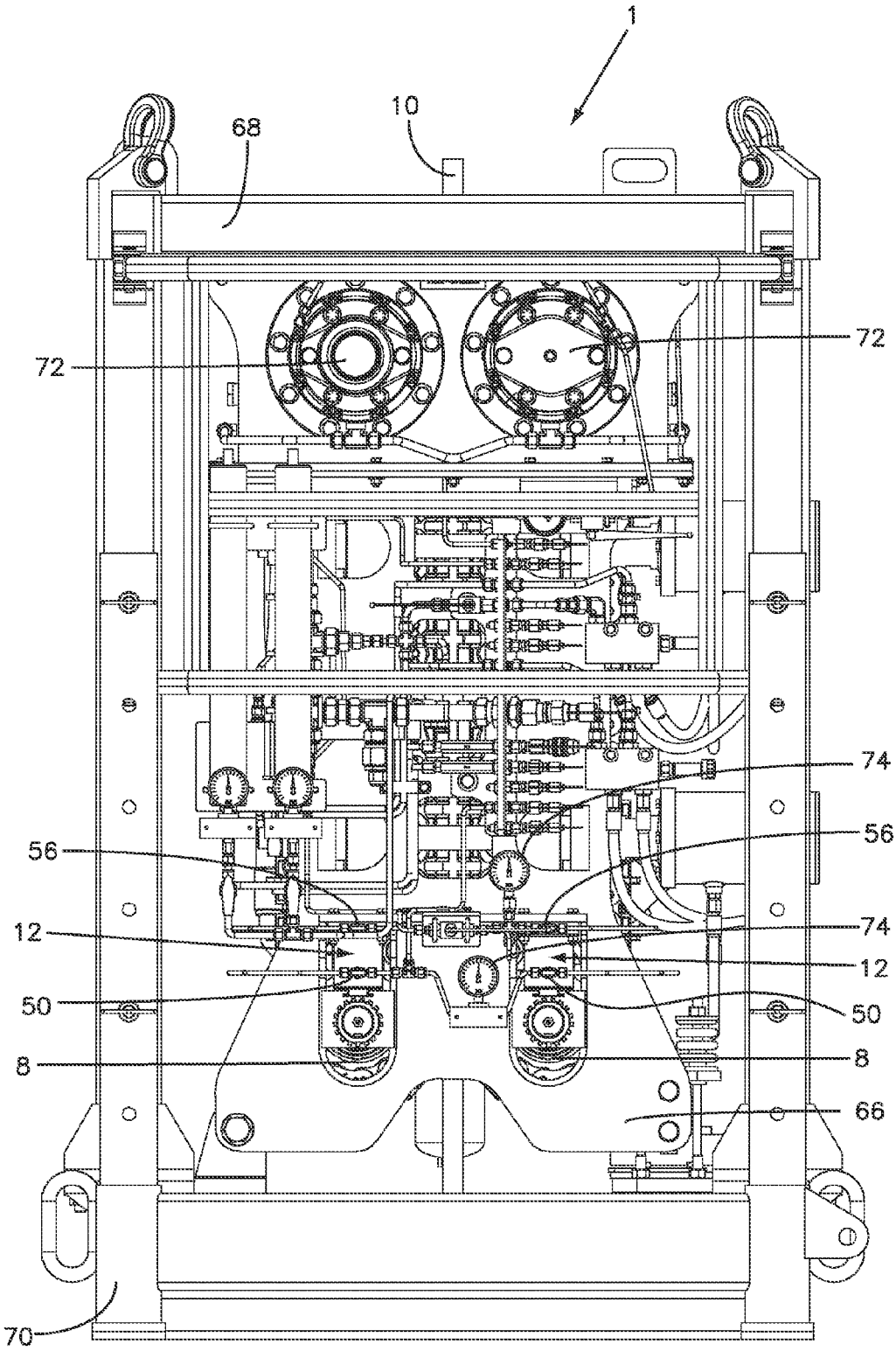
FIG. 2 is a front view of an injector head according to an embodiment of the present invention.
Figure 3:
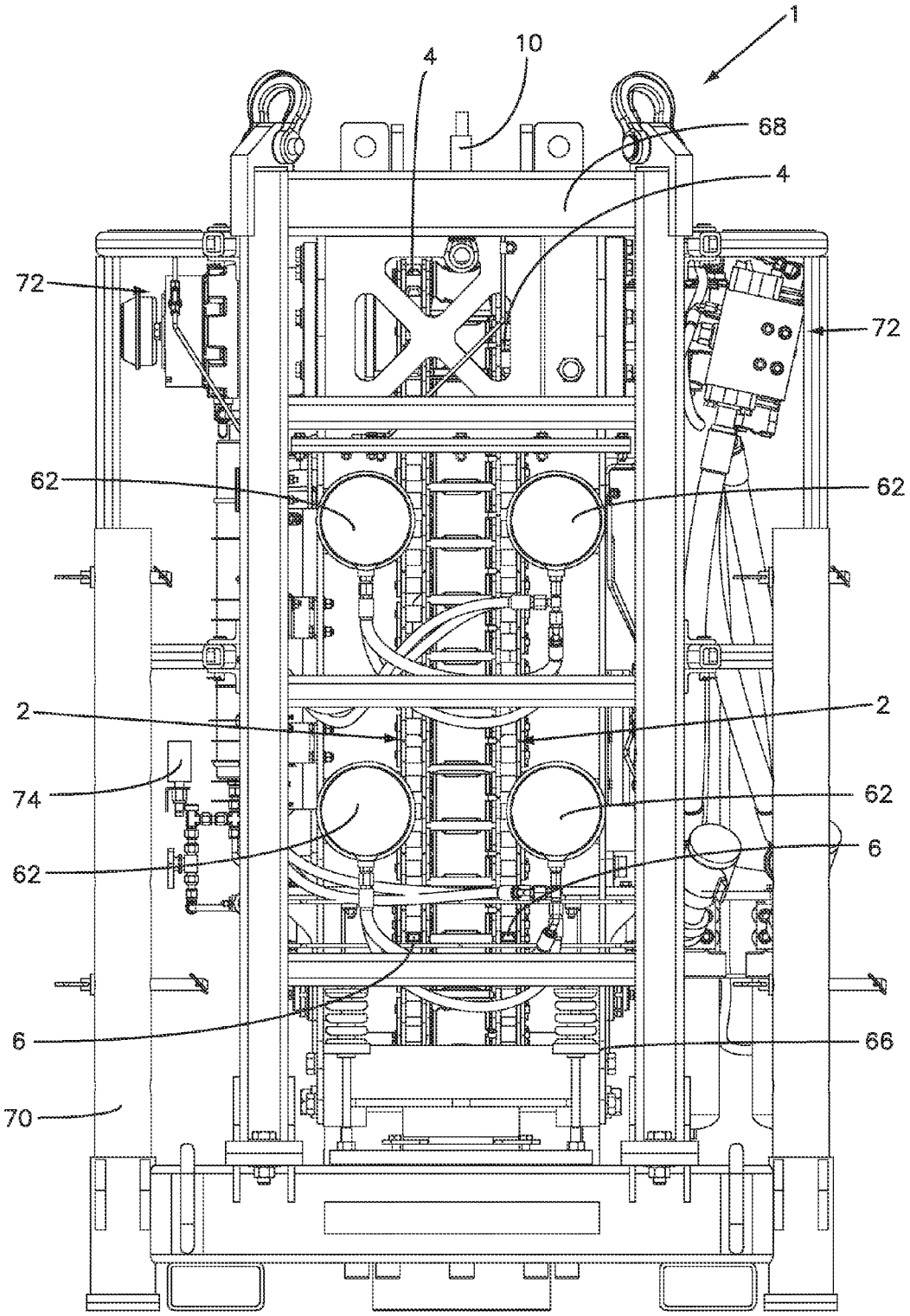
FIG. 3 is a right side view of an injector head according to an embodiment of the present invention.
Figure 4:
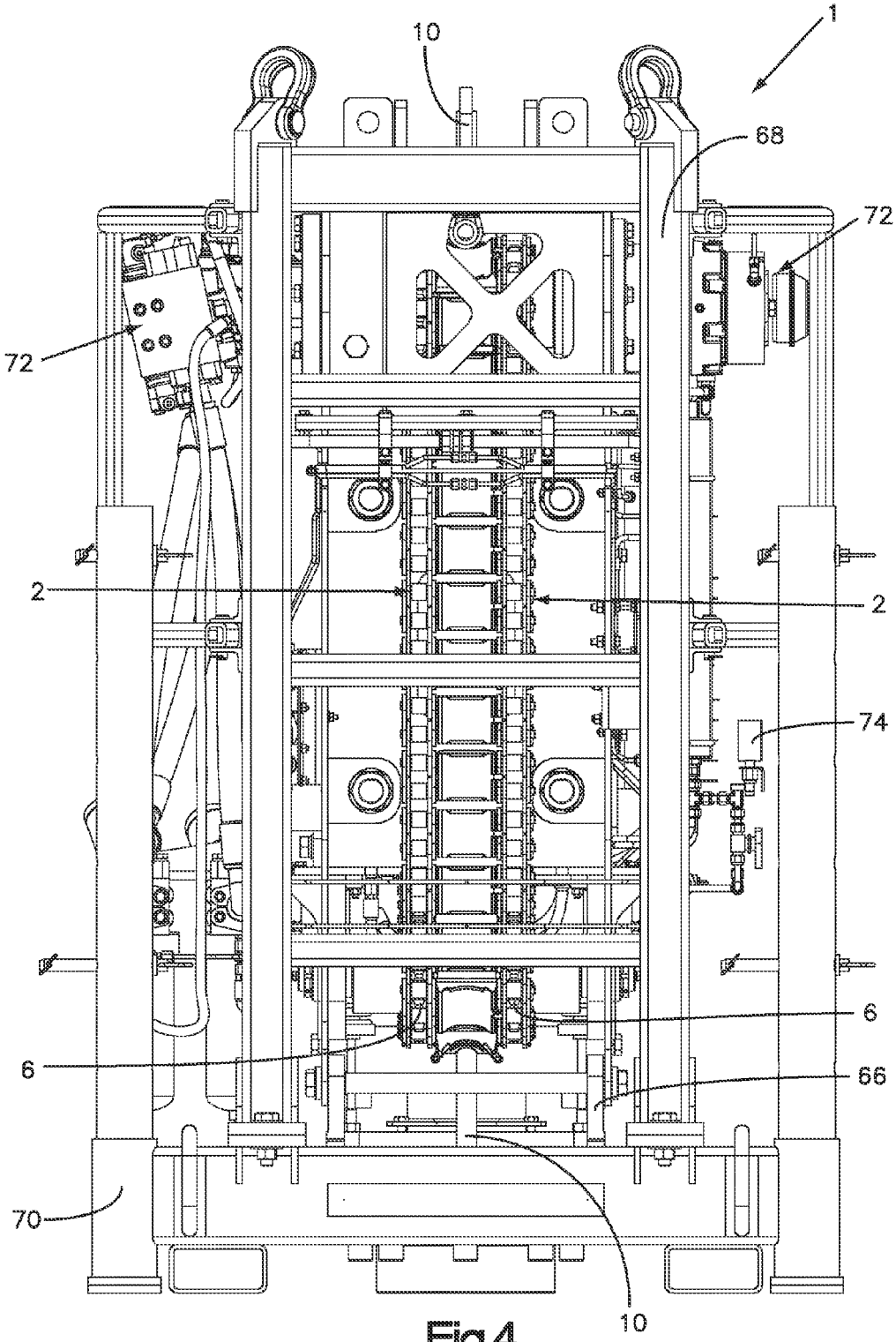
FIG. 4 is a left side view of an injector head according to an embodiment of the present invention.
Figure 5:
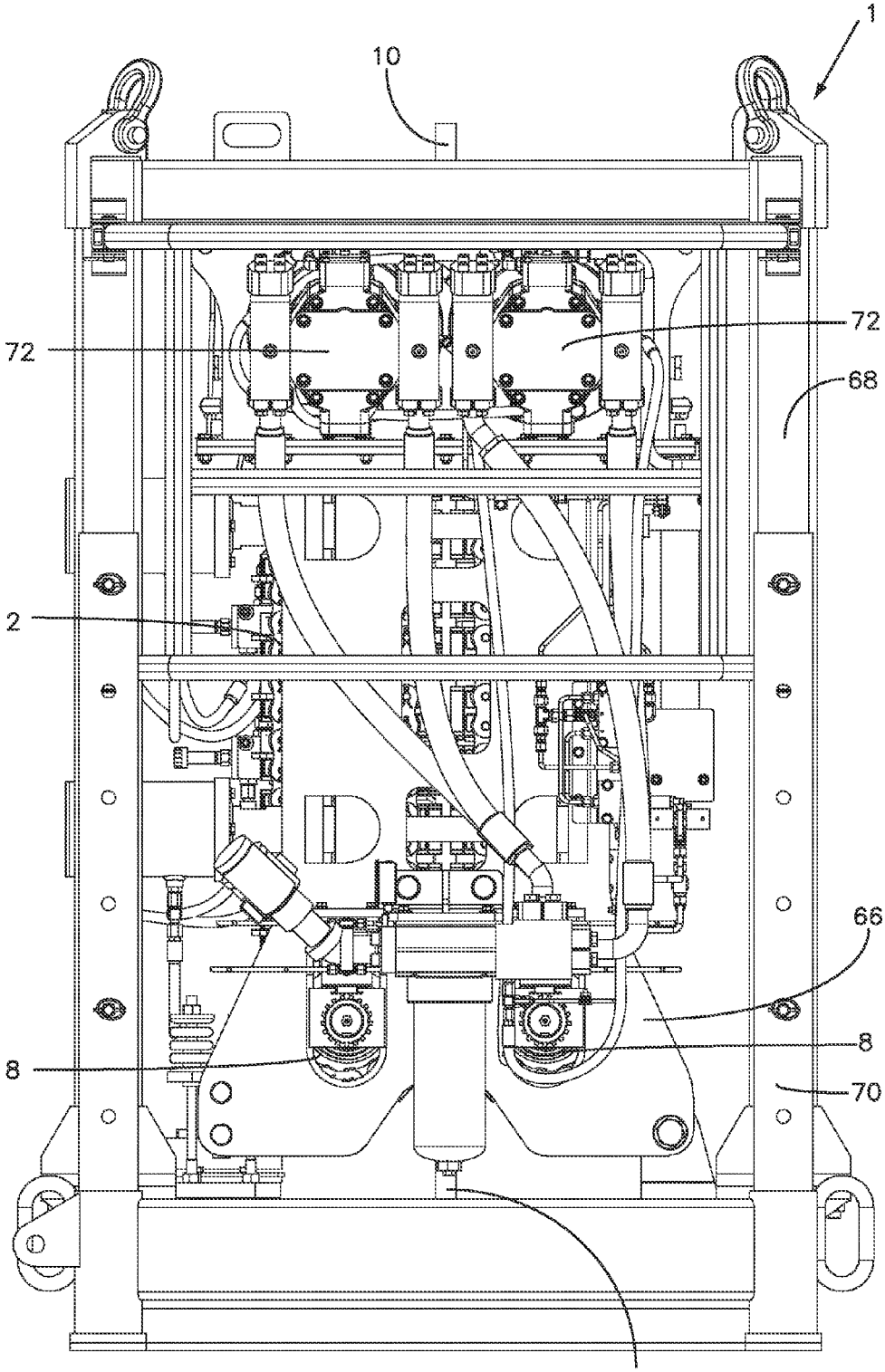
FIG. 5 is a rear view of an injector head according to an embodiment of the present invention.

As depicted in FIG. 2, various piping may be connected to the first and second ports 46, 48 of the tension cylinder 12. The piping may include gauges 74 such as pressure gauges for obtaining relevant measurements that would be helpful to an operator of the coiled tubing injector head 1 according to an embodiment of the present invention. In an embodiment of the present invention, a chain tension pressure control valve is connected to the first port 46 and a relief valve 56 is connected to the second port 48.

As is known to a person of ordinary skill in the art, the chains 2 comprise endless chains that rotate (one clockwise and the other counter-clockwise) via the drive assemblies 72 coupled to the drive sprockets 4. However, one skilled in the art will understand that the embodiments of the present invention need not include a chain—for example, a conveyor member may be used in lieu of a chain. The particular types of sprockets, fraction cylinders, motors, chains, and other components used in the coiled tubing injector head 1 according to embodiments of the present invention are all matters of design choice, and the selection and sizing of which may vary depending upon a particular application. These features are matters within the level of those of ordinary skill in the art, and should not be considered a limitation of the embodiments of the present invention.

Figure 6:
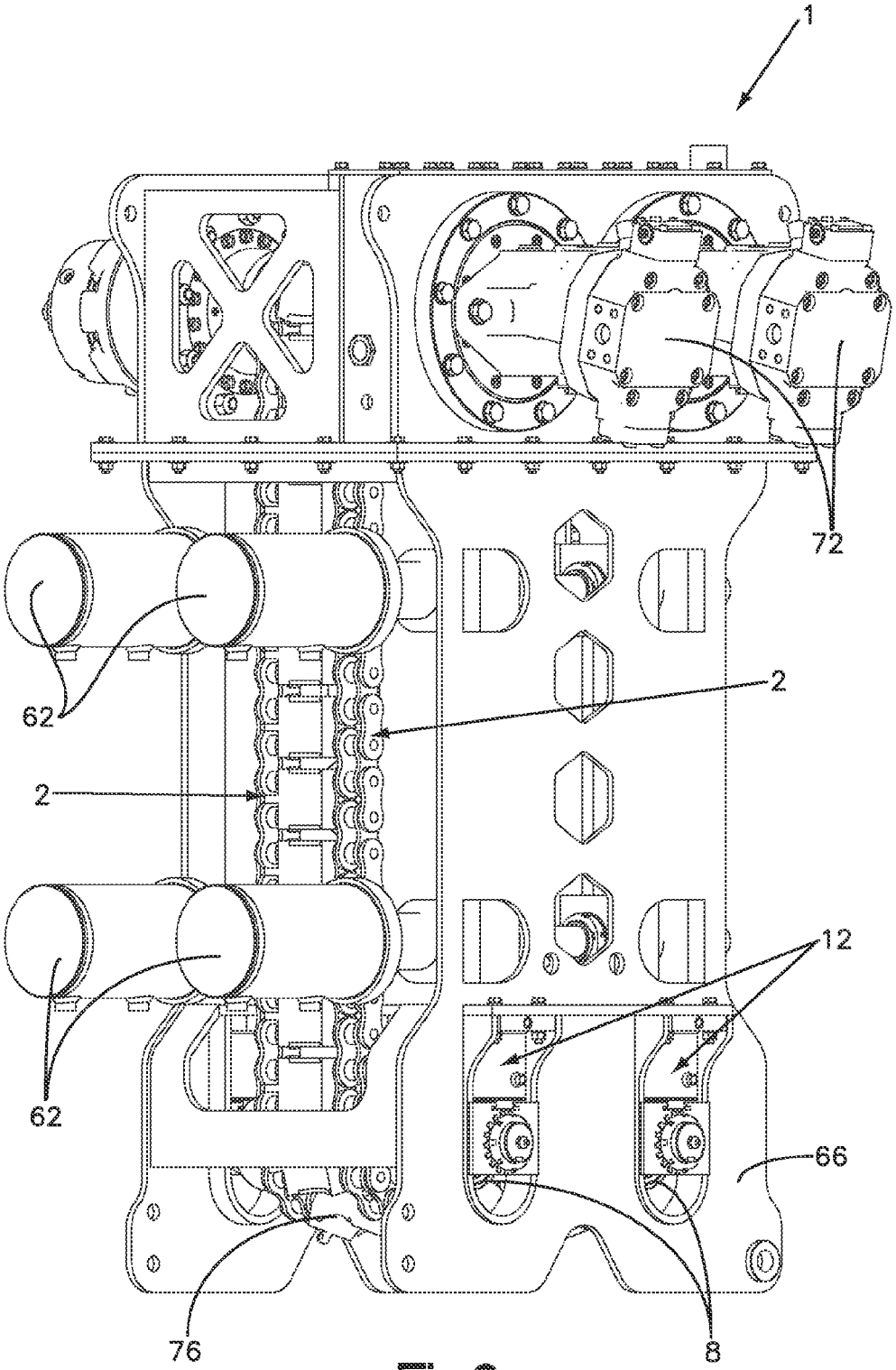
FIG. 6 is a front/side perspective view of an injector head according to an embodiment of the present invention

FIG. 6 depicts a coiled tubing injector head 1 according to an embodiment of the present invention without the outer and base frames 66, 68, and most of the other piping and additional mechanical elements common in injector heads removed for clarity. The inner frame 66 of the coiled tubing injector head 1 is clearly shown in this figure, as well as in FIGS. 7 and 8. In an embodiment of the present invention, the chains 2 include gripper blocks 76 for gripping the coiled tubing 10.

Figure 7:
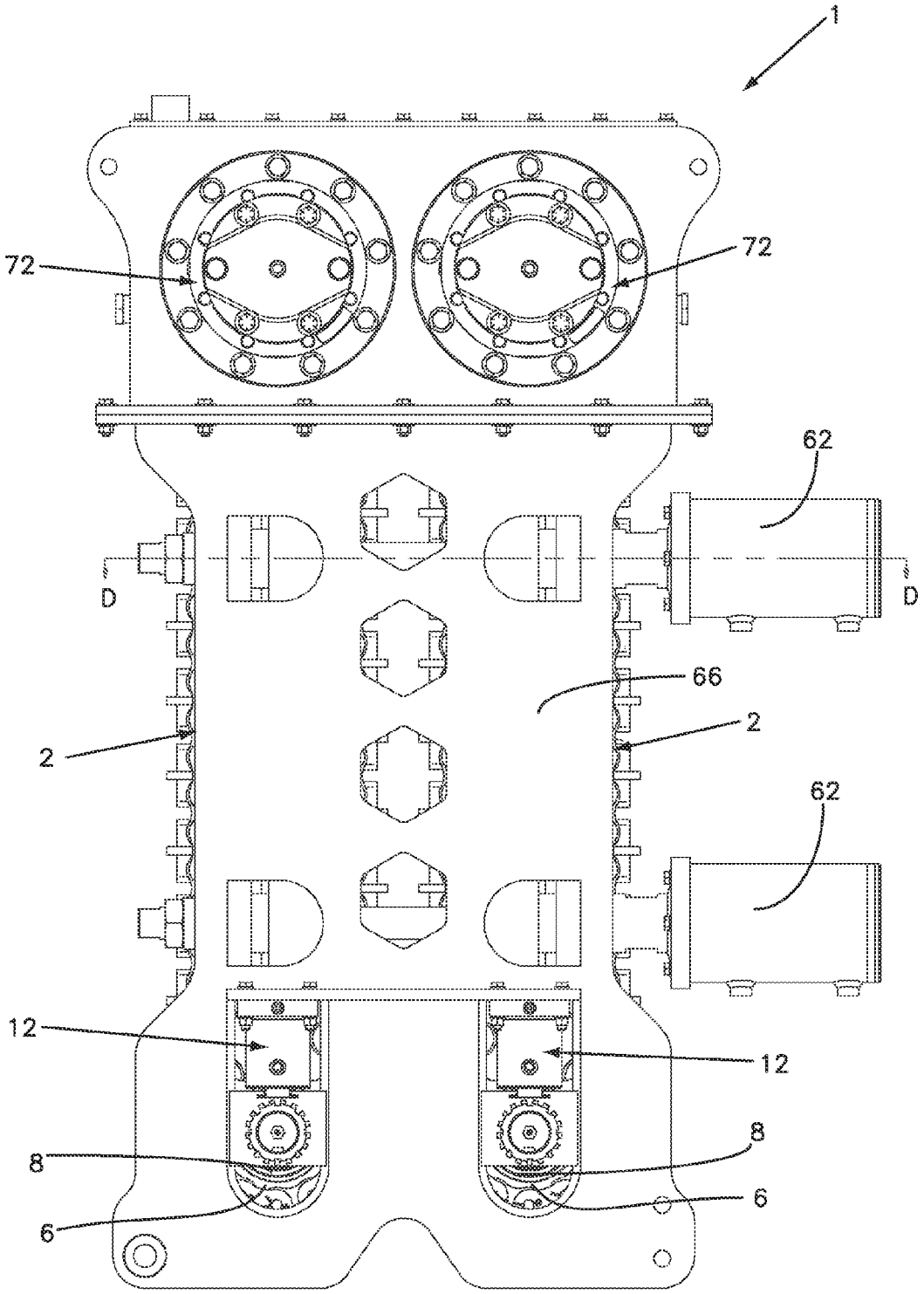
FIG. 7 is a front view of an injector head according to an embodiment of the present invention.
Figure 8:
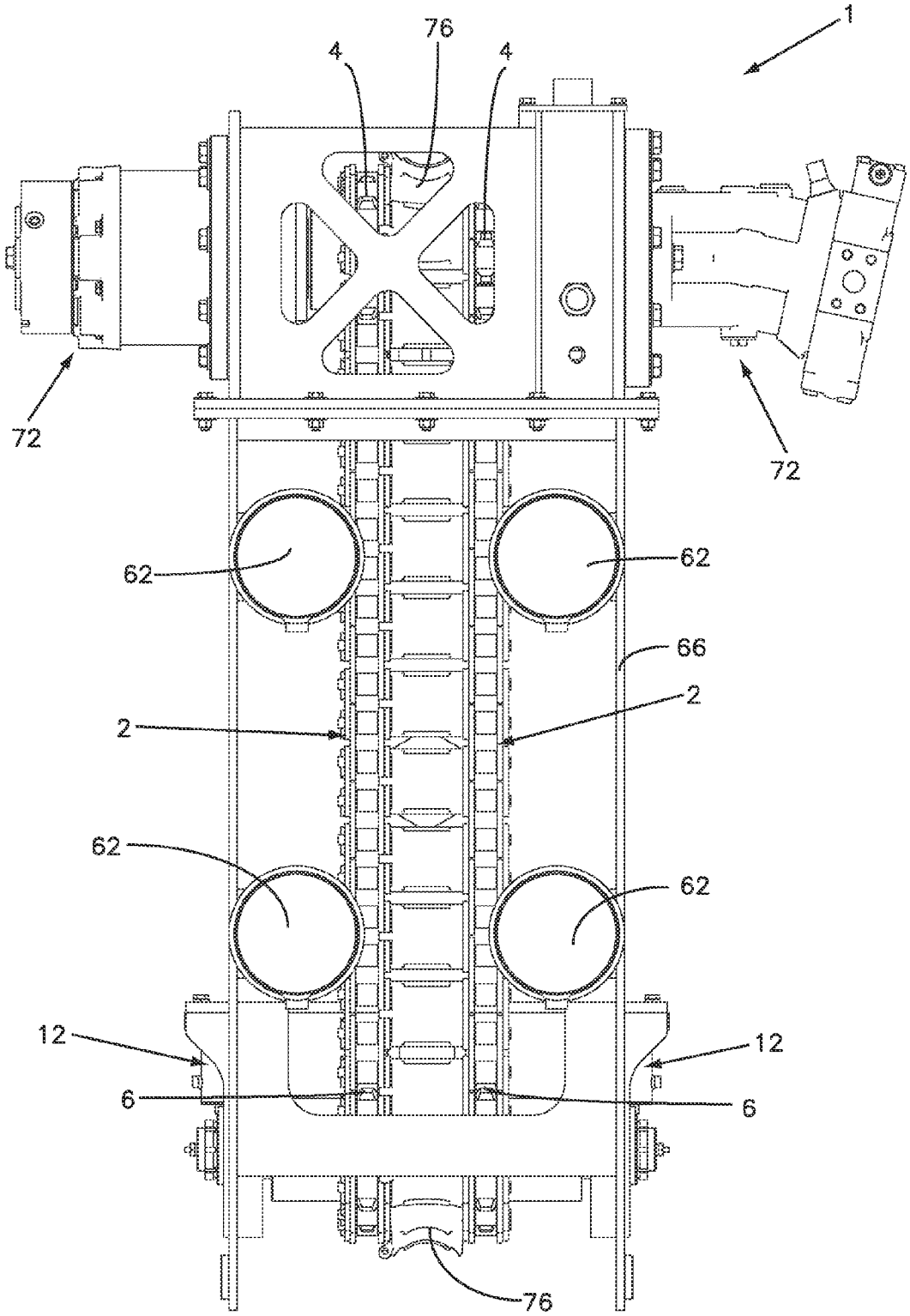
FIG. 8 is a right side view of an injector head according to an embodiment of the present invention.
Figure 9:
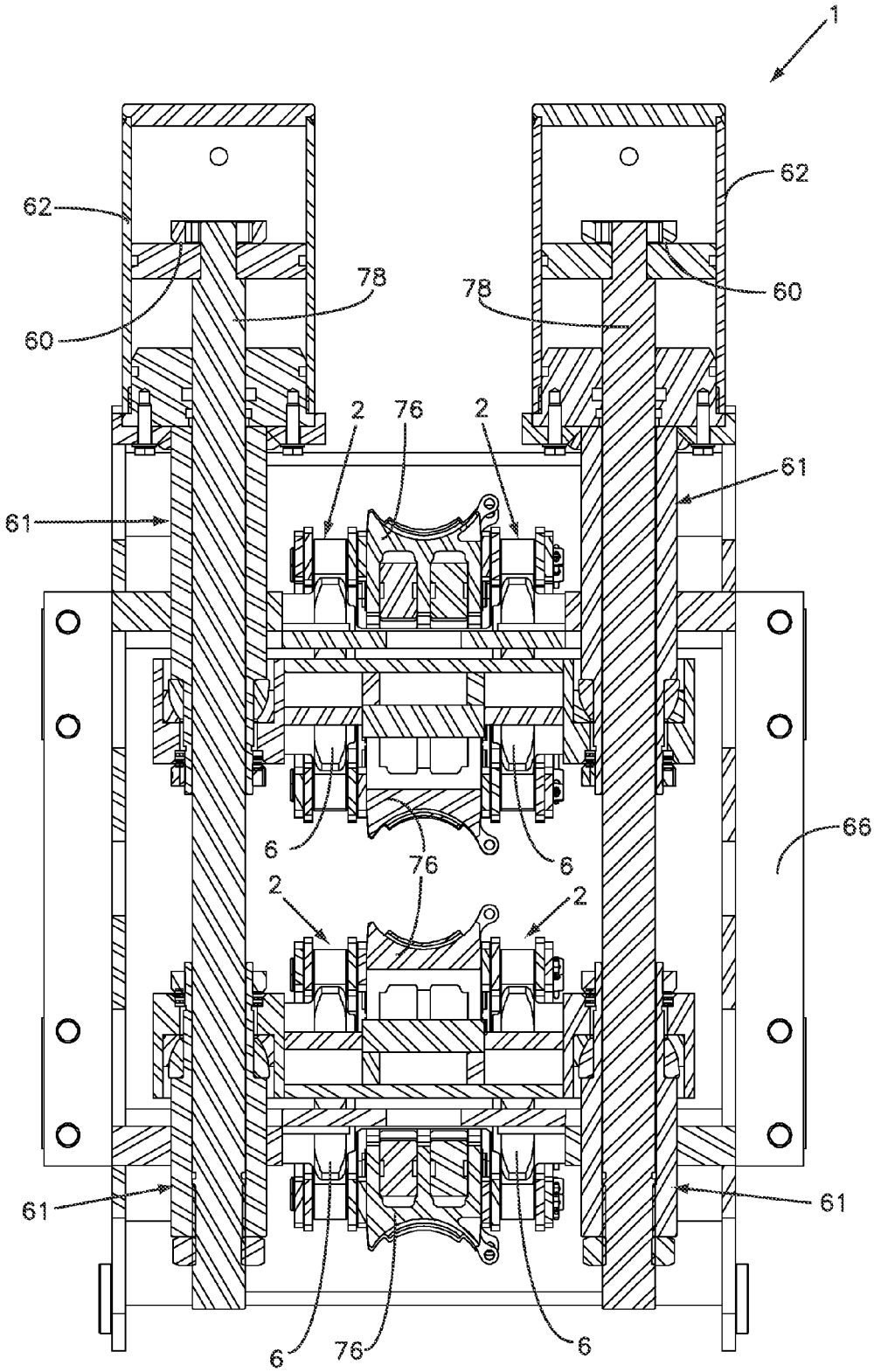
FIG. 9 is a cross-sectional view through line D-D of FIG. 7.
Figure 10:
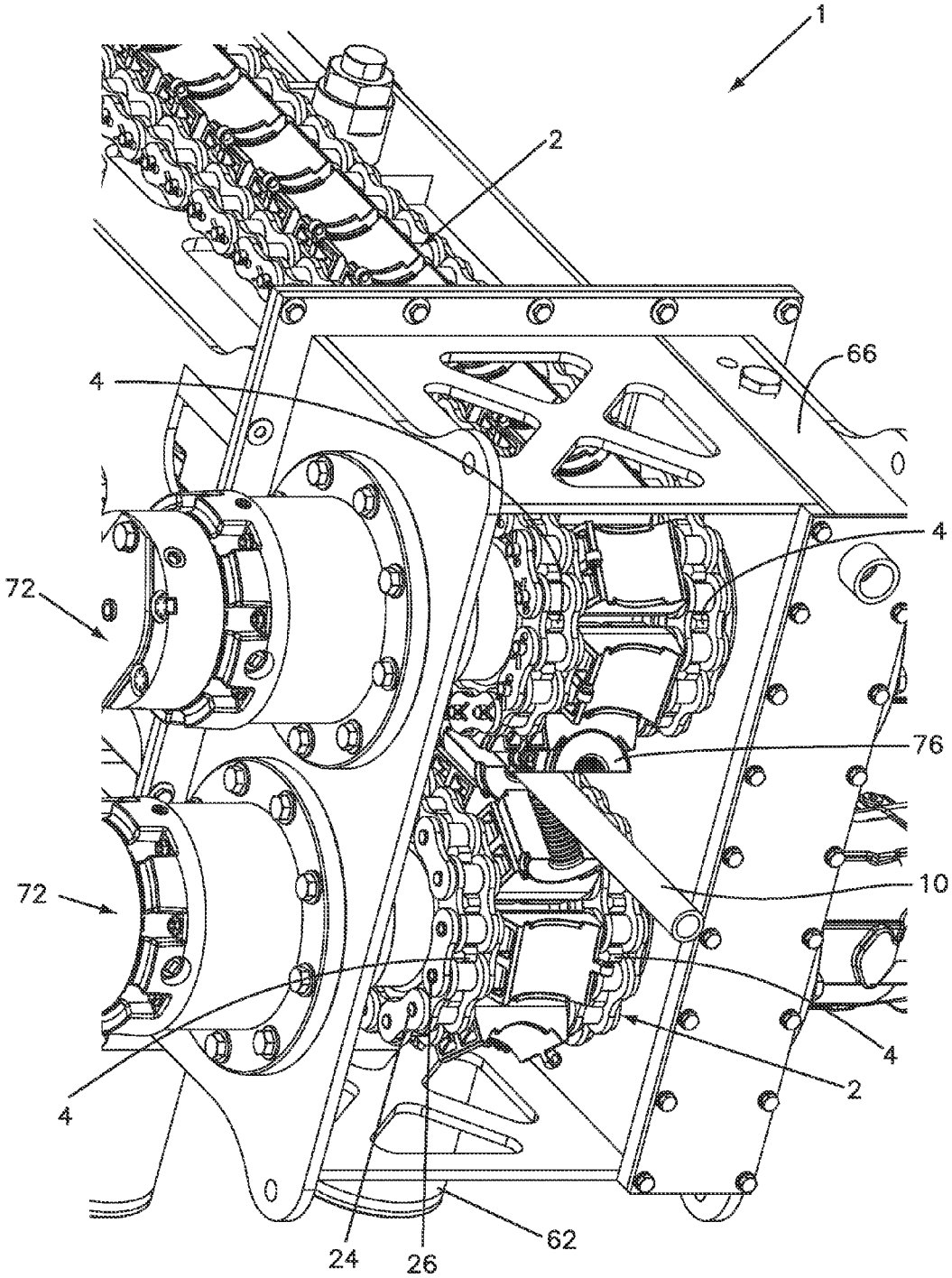
FIG. 10 is a top perspective view of an injector head according to an embodiment of the present invention.
Figure 11:
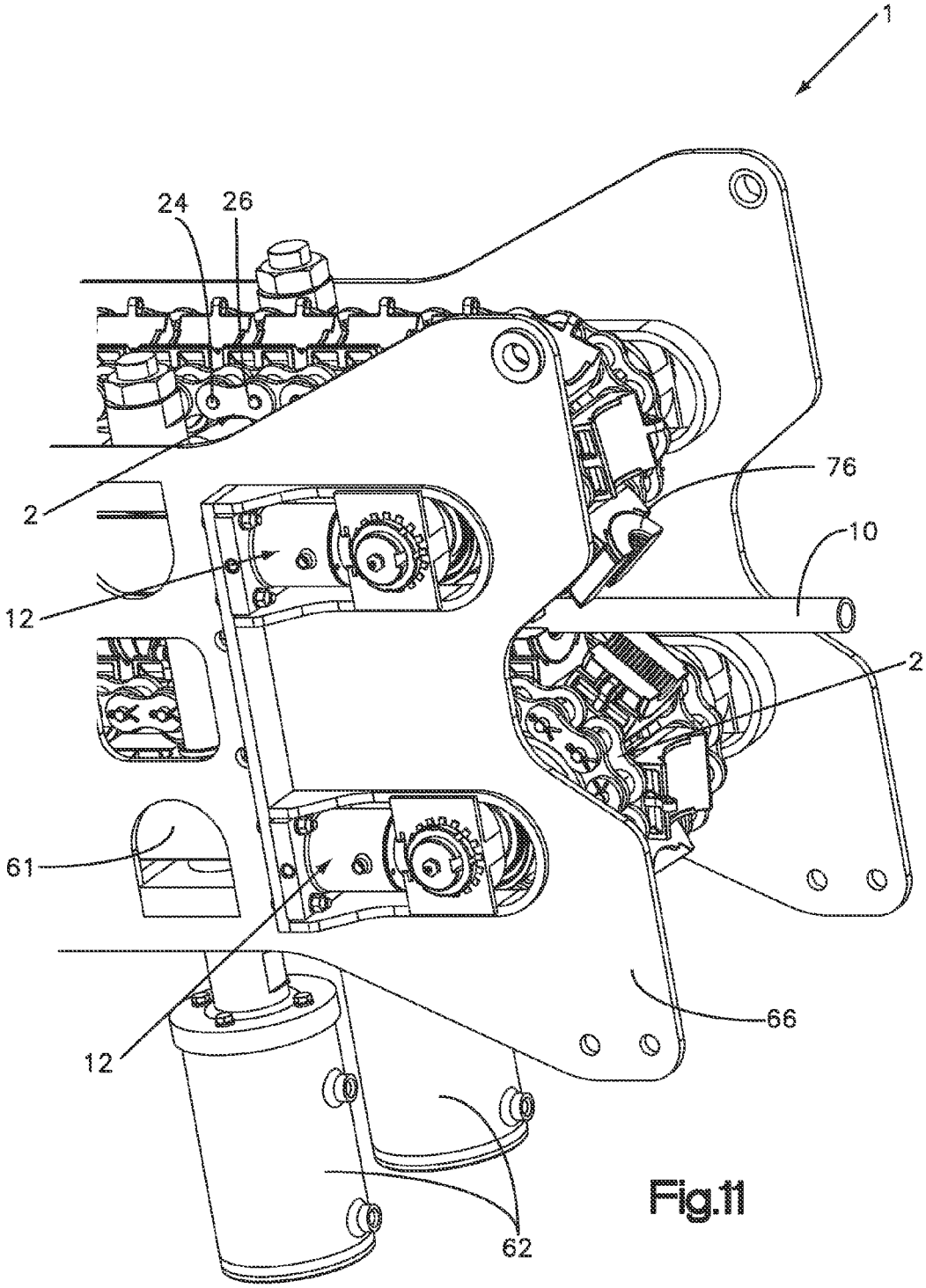
FIG. 11 is a bottom perspective view of an injector head according to an embodiment of the present invention.

FIG. 9 is a cross-sectional view through line D-D of FIG. 7. In FIG. 9, the inner workings of the traction cylinder 62 are visible including the piston 60 and rod 78, as well as the traction cylinder ram 64. In the embodiment shown in FIG. 9, the skates 61 engage the ram 64 of the piston 60 of the traction cylinders 62 in an embodiment of the present invention. As stated above, in an embodiment of the present invention, the gripping force on the coiled tubing 10 may be controlled by the amount of force applied by the traction cylinders 62.

FIG. 12 is a close-up view of the bottom of an injector head 1 according to an embodiment of the present invention, where a portion of the inner frame 66 has been removed to clearly display the components of the injector head 1.

During operation, coiled tubing 10 is inserted through the top of the coiled tubing injector head 1 where it engages with the plurality of gripper block assemblies 76 as the chains 2 are rotated by the drive assemblies 72. An operator of the coiled tubing injector head 1 according to the embodiments of the present invention sets a proper chain tension pressure that prolongs the useful life of the chains 2. Then, in operation, the coiled tubing injector head 1 according to embodiments of the present invention automatically adjusts to compensate for an increase in chain length due to wear through the use of the tension cylinder 12.

It will be obvious to a person of ordinary skill that the coiled tubing injector heads according to the embodiments of the present invention are able to accommodate coiled tubing of different sizes. Additionally, one skilled in the art would readily understand that an embodiment of the present invention includes an injector head in a vertical configuration as depicted in the figures. However, one skilled in the art would also readily understand that the embodiments of the present invention also include injector heads that may be configured in different alignments and configurations, for example horizontal or diagonal.

List of Reference Numbers Included in Figures:
The following is a list of reference numbers used in the attached figures for embodiments of the present invention:

(1) Coiled Tubing Injector Head
(2) Chain
(4) Drive Sprocket
(6) Floating Sprocket
(8) Slot
(10) Coiled Tubing
(12) Tension Cylinder
(14) Cylinder Barrel/Cylinder
(16) Cylinder Head
(18) Rod
(20) Piston
(21) Ram
(22) Spring
(24) Pin
(26) Bushing
(28) First Chamber
(30) Second Chamber
(32) Check Valve
(34) Retainer
(36) Cylinder Head Seal
(38) Rod Seal
(40) Rod Wiper
(42) Piston Seal
(44) Injector Head Lower Shaft
(46) First Port
(48) Second Port
(50) Chain Tension Pressure Control Valve
(52) Slot
(54) End of the Rod
(56) Relief Valve
(58) Roller (Moving)
(60) Piston (Traction Cylinder)
(61) Skate
(62) Moving Traction Cylinder
(64) Ram (Traction Cylinder)
(66) Inner Frame
(68) Outer Frame
(70) Base Frame
(72) Drive Assembly
(74) Guages
(76) Gripper Block Assembly

I claim:

1. An injector head used in coiled tubing systems comprising:

a. at least two opposed counter-rotating chain loops having a first end and a second end, the chain loops comprising a chain;

b. a fixed drive sprocket disposed at the first end of a chain loop and a floating sprocket disposed at the second end of the chain loop;

c. a force applied to the floating sprocket disposed at the second end of the chain loop to maintain the chain loop at a desired chain tension; and d. a tension cylinder that automatically maintains the chain loop at the desired chain tension, wherein the tension cylinder further comprises:

e. a cylinder head and a cylinder head seal;

f. a rod and a rod seal;

g. a rod wiper;

h. a cylinder barrel;

i. a retainer;

j. a piston seal;

k. a piston and a cylinder, wherein the piston divides the cylinder into at least two chambers, a first chamber and a second chamber, each chamber comprising a piston area, and wherein the piston area is substantially the same in the first and second chambers; and l. a check valve connecting the first and second chambers, wherein the check valve allows fluid and pressure to pass from the first chamber to the second chamber.

2. The injector head according to claim 1, further comprising a mechanical stop to prevent the floating sprocket disposed at the second end of the chain loop from moving toward the first end of the chain loop.

3. The injector head according to claim 1, wherein the tension cylinder further comprises a cylinder barrel, a cylinder head, a piston, and a rod.

4. The injector head according to claim 3, wherein a connection between the piston and rod allows the tension cylinder to automatically adjust a tension of the chain loop.

5. The injector head according to claim 3, wherein the tension cylinder further comprises a biasing member that engages the rod and the piston.

6. The injector head according to claim 5, wherein the biasing member allows the tension cylinder to automatically adjust a tension of the chain loop.

7. The injector head according to claim 5, wherein the biasing member is a spring.

8. The injector head according to claim 1, further comprising:

a. sprocket shafts engaged with the floating sprocket disposed at the second end of the chain loop, wherein the rod is engaged with the sprocket shafts and the rod is coupled with the piston by the retainer; and b. a biasing member mounted between the piston and the rod, wherein the biasing member maintains a distance substantially equivalent to a chordal movement of the chain on the sprockets, c. wherein the tension cylinder further comprises two ports, a first port and a second port, wherein the first port is connected to a chain tension pressure control valve, d. wherein the first port bleeds air from the cylinder, and the second port is plugged during operation of the injector head, e. wherein forces from the chain tension push the rod against the floating sprocket in the chain loop, f. wherein if forces push the floating sprocket toward the first end of the chain loop, the rod will travel a distance substantially equal to the distance maintained by the biasing member, and g. wherein the floating sprocket is prevented from moving past a location of the piston in the cylinder.

9. The injector head according to claim 8, further comprising a relief valve installed at the second port.

10. The injector head according to claim 1, further comprising sprocket shafts engaged with the floating sprocket disposed at the second end of the chain loop, wherein the rod includes slots cut into an end of the rod, the rod is engaged with the sprocket shafts, and the rod is coupled with the piston by the retainer.

11. The injector head according to claim 1, further comprising rollers that are engaged with the chain and move with the chain.

12. The injector head according to claim 1, further comprising floating/moving traction cylinders.

13. The injector head according to claim 1, further comprising stationary traction cylinders.

14. A method of automatically adjusting the tension of a chain in an injector head used in coiled tubing systems comprising:

a. applying a force to a floating sprocket to maintain a chain loop at a desired chain tension, wherein the injector head comprises:

i. at least two opposed counter-rotating chain loops having a first end and a second end, the chain loops comprising a chain; and ii. a fixed drive sprocket disposed at the first end of the chain loop, wherein the floating sprocket is disposed at the second end of the chain loop;

b. preventing the floating sprocket disposed at the second end of the chain loop from moving toward the first end of the chain loop using a mechanical stop; and c. automatically maintaining the chain loop at the desired chain tension using a tension cylinder, wherein the tension cylinder comprises:

d. a cylinder head and a cylinder head seal;

e. a rod and a rod seal;

f. a rod wiper;

g. a cylinder barrel;

h. a retainer;

i. a piston seal;

j. a piston and a cylinder, wherein the piston divides the cylinder into at least two chambers, a first chamber and a second chamber, each chamber comprising a piston area, and wherein the piston area is substantially the same in the first and second chambers; and k. a check valve connecting the first and second chambers, wherein the check valve allows fluid and pressure to pass from the first chamber to the second chamber.

15. The method of claim 14, wherein the tension cylinder further comprises a cylinder barrel, a cylinder head, a piston, and a rod, and wherein a connection between the piston and rod allows the tension cylinder to automatically adjust a tension of the chain loop.

16. The method of claim 15, wherein the tension cylinder further comprises a biasing member that engages the rod and the piston, and wherein the biasing member allows the tension cylinder to automatically adjust a tension of the chain loop.

17. The method of claim 14, wherein the injector head further comprises rollers that are engaged with the chain and move with the chain.

18. The method of claim 14, wherein the injector head further comprises floating/moving traction cylinders.

19. An injector head used in coiled tubing systems comprising:

a. at least two opposed counter-rotating vertical chain loops having a top and a bottom, the chain loops comprising a chain;

b. a fixed drive sprocket at the top of a vertical chain loop and a floating sprocket at the bottom of the vertical chain loop;

c. a force applied to the floating sprocket at the bottom of the vertical chain loop to keep the chain loop tight thereby creating a desired chain tension;

d. a mechanical stop to prevent the floating sprocket at the bottom of the vertical chain loop from moving toward the top of the vertical chain loop;

e. a tension cylinder that automatically maintains the chain loop at the desired chain tension, the tension cylinder further comprising:

i. a cylinder barrel;

ii. a cylinder head and a cylinder head seal;

iii. a rod and a rod seal;

iv. a rod wiper;

v. a retainer ring;

vi. a floating piston and a cylinder, wherein the piston divides the cylinder into two chambers, a first chamber and a second chamber, each chamber comprising a piston area, and wherein the piston area is substantially the same in the first and second chambers;

vii. a spring mounted between the piston and the rod, wherein the spring maintains a distance substantially equivalent to chordal movement of the chain on the sprockets;

viii. a piston seal;

ix. a check valve connecting the first and second chambers, wherein the check valve allows fluid and pressure to pass from the first chamber to the second chamber, but the check valve does not allow fluid and pressure to pass from the second chamber to the first chamber; and x. two ports, a first port and a second port, wherein the first port is connected to a chain tension pressure control valve, and wherein the first port bleeds air from the cylinder, and the second port is plugged during operation of the injector head;

f. sprocket shafts engaged with the floating sprocket at the bottom of the vertical chain loop, wherein the rod includes slots that are cut into an end of the rod, the rod is connected to the sprocket shafts, and the rod is connected to the piston with the retainer ring;

g. rollers that are engaged with the chain and move with the chain;

h. floating/moving traction cylinders, i. wherein forces from the chain push the rod against the floating sprocket in the chain loop, j. wherein if forces push the floating sprocket toward the top of the chain loop, the rod will travel a distance substantially equal to the distance maintained by the biasing member, and k. wherein the floating sprocket is prevented from moving past a location of the piston in the cylinder.

* * * * *